US006607149B2

(12) United States Patent
Smith et al.

(10) Patent No.: US 6,607,149 B2
(45) Date of Patent: Aug. 19, 2003

(54) FOLLOWER ASSEMBLY WITH RETAINER CLIP FOR UNIT INJECTOR

(75) Inventors: Daniel Smith, Spring Lake, MI (US); David Eickholt, Kentwood, MI (US); Michael Weston, Lawrence, MI (US)

(73) Assignee: Robert Bosch Fuel Systems Corporation, Kentwood, MI (US)

( * ) Notice: Subject to any disclaimer, the term of this patent is extended or adjusted under 35 U.S.C. 154(b) by 0 days.

(21) Appl. No.: 10/035,076

(22) Filed: Dec. 28, 2001

(65) Prior Publication Data

US 2003/0121996 A1 Jul. 3, 2003

(51) Int. Cl.[7] ..... B05B 1/30

(52) U.S. Cl. ..... 239/585.1; 239/88; 239/533.2; 285/305; 411/353

(58) Field of Search ..... 239/88–96, 124–127, 239/533.2, 533.11, 585.1–585.5; 123/495–509, 470, 468, 90.61, 90.62; 285/303, 305, 302; 411/353, 352, 517–521

(56) References Cited

U.S. PATENT DOCUMENTS 4,531,496 A * 7/1985 Thomas ..... 123/495
5,402,764 A * 4/1995 Rossignol et al. ..... 123/495
5,820,754 A * 10/1998 Cassidy et al. ..... 210/232
5,909,725 A * 6/1999 Balsdon et al. ..... 123/516
5,970,953 A * 10/1999 Lorraine et al. ..... 123/470
5,979,411 A * 11/1999 Ricco ..... 123/469
6,209,798 B1 * 4/2001 Martin et al. ..... 239/88

* cited by examiner

*Primary Examiner*—Michael Mar
*Assistant Examiner*—Dinh Q. Nguyen
(74) *Attorney, Agent, or Firm*—Brooks & Kushman P.C.

(57) ABSTRACT

A fuel injector unit comprises a follower assembly that includes a sleeve having an internal groove that receives a spring clip. The clip is made with a spring ring stock having a diameter less then the width of the groove so that the sleeve may be freely rotated around the retainer clip held in the groove. The retainer clip has linear portions aligned along the flat walls of a follower subassembly that receives a plunger carried by the follower assembly. The flat walls terminate at an expanded shoulder that limits displacement of the retainer clip to a fixed height of the follower assembly for shipping and handling, while permitting controlled axial movement of the follower assembly and the plunger along the aligned flat surfaces of the follower subassembly.

9 Claims, 2 Drawing Sheets

FOLLOWER ASSEMBLY WITH RETAINER CLIP FOR UNIT INJECTOR

BACKGROUND OF THE INVENTION

1. Field of the Invention

The present invention relates to internal combustion engine fuel injectors in which a pump, a control valve assembly and an injector nozzle are formed in a unit, and where the pump has a follower assembly that includes a sleeve retained by a spring clip.

2. Background Art

As performance, efficiency and environmental concerns continually influence the design and operation of internal combustion engines, fuel injectors, like other components, have become more complex. Moreover, not only the structures themselves but the procedures for installing the structures may multiply the time, expense and difficultly in employing the new technological developments. This is particularly true in unit injectors in which a pump assembly, a control valve module and an injector nozzle are formed as a single unit.

In the pump assembly of the unit injector, a plunger is carried by a follower responsive to a cam, rocker arm or other reactive engine operating component relating to the combustion cycle. As the plunger is driven by the follower, the plunger chamber forms a reduced volume, high pressure fuel chamber that is coupled through a control valve assembly to the injector nozzle. The follower assembly must move freely in the direction of the plunger axis while avoiding misalignments with respect to the axis of the plunger. Moreover, while the follower is resiliently biased to an extended position for engagement with the cam, the follower must permit uniform handling, storage and installation in a mass production operation. Accordingly, reliance upon a relaxed spring state would not be sufficient to maintain uniformity of size and shape of the injector unit before installation in an engine. Moreover, while free movement of the mating surfaces permits physical contact to avoid a predetermined wear pattern in the mating surfaces, off axis movement should be constrained to avoid excessive wearing of the sliding plunger parts.

SUMMARY OF THE INVENTION

The present invention overcomes the above mentioned disadvantages by providing a fuel injector pump assembly in which a follower is formed as a sleeve that telescopically receives a portion of the injector unit body and a retainer clip is loosely retained in a groove in the sleeve and interacts with a protruding portion of the injector unit body. In general, the sleeve includes a ring groove on an inner peripheral surface of the sleeve that is wider than the cross-section of the clip stock and loosely retains the clip within the groove, permitting relative movement between the retainer ring and the sleeve. Preferably, the protruding portion of the body includes flat surfaces that are aligned with linear portions of the retainer ring. The protruding portion includes an expanded flange that restricts extraction of the ring over the end of the protrusion as the sleeve is resiliently biased toward an extended position by a spring. An end of the protruding portion has a surface opposite to the flat surface that includes a taper for displacing the clip over the end of the protruding portion during assembly.

As a result, the follower assembly allows a specified plunger stroke, while the sleeve/follower assembly maintains contact with the body to prevent side loading. Moreover, the assembly maintains a predetermined shipping height because the linear portion of the clip engages the expanded shoulder of the protruding portion. The retainer clip is easily installed by its loose capture in the groove in the sleeve, and can be snapped over the protruding body toward the linear portions of the clip, and aligning the linear clip portions with the flats on the protrusion by rotating the follower assembly while it is compressed. In the preferred embodiment, the sleeve may also include a hole over the slot between clip ends so that disassembly of the sleeve from the protruding portion of the unit injector housing can be accomplished by inserting a tool in the hole and into the gap between the ends of the clip, and rotating the follower assembly to force the linear portions of the clip outwardly as the follower assembly sleeve is rotated about the protruding portion.

BRIEF DESCRIPTION OF THE DRAWINGS

The present invention will be more clearly understood by reference to the following detailed description of a preferred embodiment when read in conjunction with the accompanying drawing in which like reference characters refer to like parts throughout the views and in which.

DETAILED DESCRIPTION OF THE PREFERRED EMBODIMENT(S)

Figure 1:
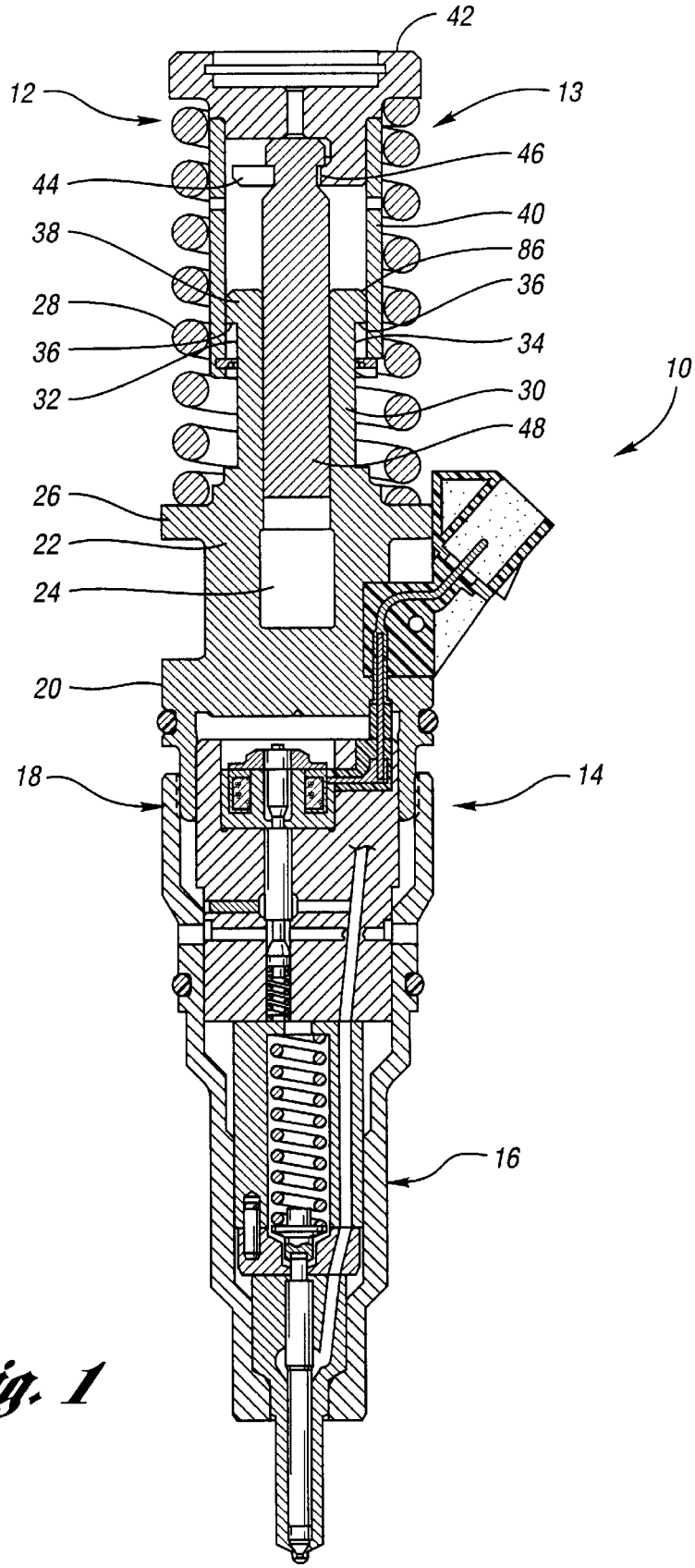
FIG. 1 is a sectional view of a unit injector constructed in accordance with the present invention.

Referring first to FIG. 1, a unit injector 10 is there shown comprising a pump assembly 13 having a follower assembly 12, a pressure control valve assembly 14 and an injector nozzle 16. The unit injector design 10 of the present invention reduces size, and complexity by maintaining the follower assembly 12, control valve assembly 14, and nozzle assembly 16 as a single in-line assembly. The pump assembly 12 of the present invention may be employed regardless of the existence or complexity of the control valve portion 14 or the type injector nozzle 12 employed with the pump 12. In addition, while each of the assemblies is preferably housed in a single housing 18, the housing 18 may be formed in multiple parts that are secured to each other in order to form an injector unit housing 18.

Figure 2:
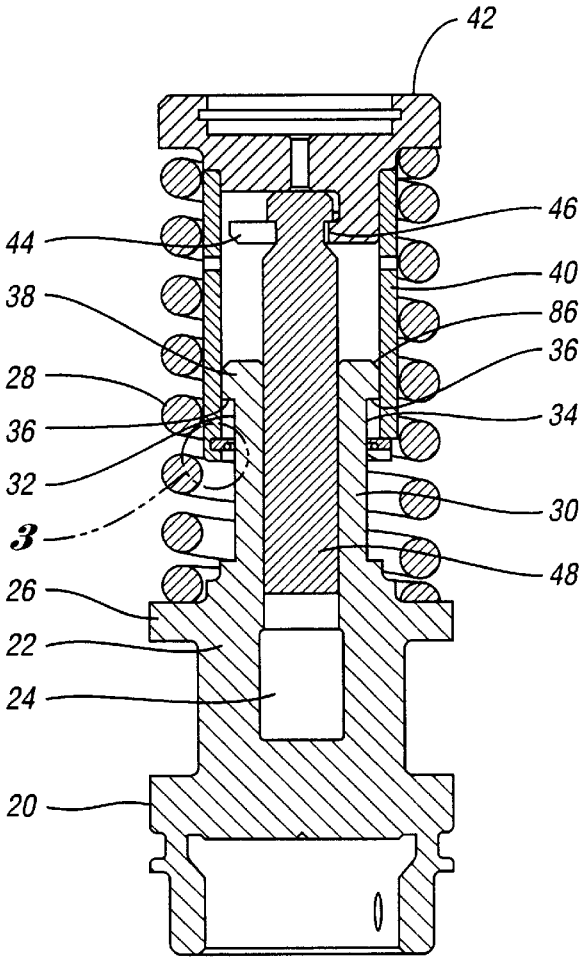
FIG. 2 is an enlarged sectional view of the follower assembly shown in FIG. 1.

As best shown in FIG. 2, a housing portion 20 intermediate the follower assembly 12 and the control valve assembly 14 includes a peripheral wall 22 defining a high pressure fuel chamber 24. Preferably, the housing portion 20 is configured to mate with or be secured to a housing portion enclosing the control valve assembly 14. In addition, an expanded flange 26 that carries a coil spring 28 coaxially to the chamber 24. Similarly, protruding portion 30 includes flat walls 32 and 34. The flat surfaces are preferably aligned parallel to the plane of the arc traversed by an engine's rocker arm, or perpendicular to the alignment of the rocker arm. An expanded shoulder 36 at the end of each flat wall 32 and 34 forms an abutment surface for a clip to limit removal of the follower assembly 12. The end 38 of the protruding portion 30 is received in a sleeve 40 carried by a follower assembly cap 42. The cap 42 includes a retaining ledge 44 holding a support groove 46 in the plunger 48.

Figure 3:
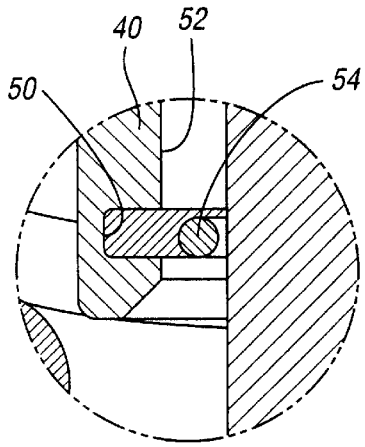
FIG. 3 is an enlarged, fragmentary sectional view of a portion of the follower assembly shown in FIG. 2.
Figure 4:
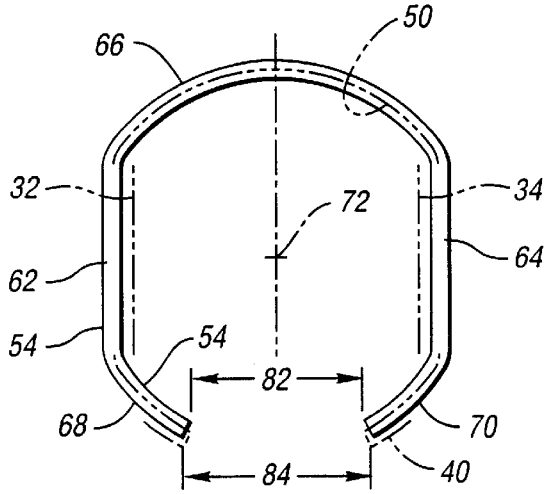
FIG. 4 is a plan view of a clip used in the follower assembly shown in FIGS. 1–3.

As best shown in FIG. 3, the sleeve 40 includes a groove 50 in the inner peripheral wall 52. As shown in FIG. 4, a retainer clip 54 made of a ring of spring metal stock having a diameter less than the width of the groove 50, but being formed in a ring with a diameter greater than the diameter of the protruding portion 30, is loosely carried within the groove 50. As best shown in FIG. 4, the ring 54 includes linear portions 62 and 64 positioned and aligned for displacement along the flat walls 32 and 34, respectively. The linear portions are joined by a rear curved portion 66 radiused to fit at least partially in the groove 50 and separated curved front portions 68 and 70 similarly radiused and spaced apart from the rear portion 66 a fixed dimension for reception in the groove 50, as shown in phantom line in FIG. 4. Accordingly, the retainer ring 54 rides in the groove 50 and the linear portions 62 and 64 resist off axis forces by alignment with the side walls 32 and 34 to resist misalignment that may be generated as the rocker arm engages the top surface of the follower cap 42 during displacement of the follower cap 42 against the action of the spring 38. Nevertheless, the sleeve 40 may be rotated about the retainer clip 54, whose alignment is restrained by the walls 32 and 34, to avoid a redundant wear pattern in the upper surface of the follower.

Referring again to FIG. 3, preferably, the end 38 is tapered as shown at 86 so that with the retainer clip 54 installed in the groove 50 of the sleeve 40, the sleeve 40 may be forced over the end 38 as the clip 54 is expanded to receive the protruding end 30 within the chamber of the sleeve 40. Nevertheless, once the retainer clip returns to its predetermined form and size retracted beneath the shoulder 36, the linear portions 62 and 64 engage the shoulder 36 to limit the displacement of the follower assembly by the coil spring 28. Accordingly, all of the follower assemblies have a fixed, limited height for purposes of handling, storage and assembling during a production operation. Moreover, once the injector unit 10 is installed in an engine, the follower assembly cap 42 is biased by the spring 38 against the rocker, cam lobe or other timing apparatus, and held at a position where the retainer ring 54 remains separated from the end shoulder 36, as shown in FIG. 2, without restricting plunger movement of the follower assembly during its operation.

Once installed, the plunger 48, cap 42 and sleeve 40 of the follower assembly 12 may be removed by inserting a rod or other tool through an opening 84, shown in phantom line in FIG. 4, that is aligned with the space 82 between curved front portion 68 and 70 of ring 54. The rod or tool is rotated about the axis 72 of the plunger 48, whereby the stem portions adjacent the flats are longer than the fixed dimension between the flat surfaces 32 and 34 to spread the clip beyond the expanded shoulder 36 and permitting the sleeve to be lifted above the stem.

Having thus described the present invention, many modifications will become apparent to those skilled in the art to which it pertains without departing from the scope and spirit of the present invention defined in the appended claims.

What is claimed is:

1. A follower assembly for a fuel injector comprising:

a plunger sleeve having a chamber formed by a peripheral wall;

a subassembly body having a stem;

a groove in said peripheral wall;

a retainer clip resiliently maintaining a fixed peripheral dimension loosely received in said groove, and having first and second linear portions separated by a fixed interior dimension between said first and second linear portions;

wherein said subassembly body stem includes a pair of flat peripheral surfaces aligned adjacent to said linear portions at said fixed dimension.

2. The invention as defined in claim 1 wherein said stem includes a tapered tip.

3. The invention in claim 1 wherein said stem includes an expanded shoulder adjacent each of said flat peripheral surfaces.

4. The invention as described in claim 3 wherein an edge of said shoulder opposite to said flat surface is tapered.

5. That invention as described in claim 1 wherein said linear portions are longer than said fixed dimension.

6. The invention as described in claim 1 wherein said flat peripheral surfaces are spaced apart a distance less than the width of the subassembly body.

7. A fuel injector comprising:

a cam follower cap including a peripheral shoulder;

a plunger with an axis carried by said cam follower cap;

a sleeve carried by said cap, and having an interior groove perpendicular to said axis;

a retainer clip rotatably carried in said groove;

a body carrying a spring resiliently biased against said peripheral shoulder;

a flow control passageway for discharging fuel from the injector in response to displacement of said plunger against said resiliently biased spring; and an outwardly extending shoulder on said body received in said sleeve above said groove.

8. The invention as described in claim 7 wherein said retainer clip includes first and second linear portions and said body includes first and second flat wall portions adjacent said outwardly extending shoulder and aligned adjacent said first and second linear portions, respectively.

9. The invention as described in claim 7 wherein said outwardly extending shoulder has a tapered end surface.

* * * * *